US005309147A

United States Patent [19]

Lee et al.

[11] Patent Number: 5,309,147

[45] Date of Patent: May 3, 1994

[54] MOTION DETECTOR WITH IMPROVED SIGNAL DISCRIMINATION

[75] Inventors: Wade P. Lee, Lafayette; Scott T. Evans, LaVerne, both of Calif.

[73] Assignee: Intelectron Products Company, Hayward, Calif.

[21] Appl. No.: 886,994

[22] Filed: May 21, 1992

[51] Int. Cl.[5] ..... G08B 13/18

[52] U.S. Cl. ..... 340/567; 340/511

[58] Field of Search ..... 340/567, 587, 511, 661, 340/527; 250/342

[56] References Cited

U.S. PATENT DOCUMENTS

| | | | |
|---|---|---|---|
| 3,631,434 | 12/1971 | Schwarz | 340/567 |
| 3,703,718 | 11/1972 | Berman | 340/567 |
| 3,760,399 | 9/1973 | Schwarz | 340/567 |
| 3,928,843 | 12/1975 | Sprout et al. | 340/567 |
| 3,958,118 | 5/1976 | Schwarz | 250/221 |
| 4,529,874 | 7/1985 | Zierhut | 250/221 |
| 4,570,247 | 2/1986 | Walker et al. | 367/93 |
| 4,668,942 | 5/1987 | Eccleston et al. | 340/551 |

OTHER PUBLICATIONS

Schematic signal processing circuit diagram, asserted by applicants to be prior art.

*Primary Examiner*—Thomas Mullen

*Attorney, Agent, or Firm*—Elliot B. Aronson

[57] ABSTRACT

An infrared motion detection device for detecting the presence of a target object including special circuitry for reducing false alarms. In particular, coupling circuitry is interposed between signal processing circuitry and comparator circuitry, which serves to match the baseline level of the signal from the signal processing circuitry with the baseline level of a threshold or thresholds defined by the comparator circuitry. The coupling circuitry may be implemented in a particularly simple manner, which reduces the manufacturing cost of the circuitry and the device.

10 Claims, 3 Drawing Sheets

MOTION DETECTOR WITH IMPROVED SIGNAL DISCRIMINATION

BACKGROUND OF THE INVENTION

The present invention relates to signal processing methods for use with infrared motion detection devices.

Infrared motion detection devices are commonly used in such applications as burglar alarm systems or automatic lighting devices. In the burglar alarm systems the device activates an alarm whenever an intruder moves into the monitored area. As part of an automatic lighting device the motion detection device causes a light to be turned on when a person or motor vehicle enters the area to be illuminated. Such devices may be used in residential lighting, for example, to illuminate a walkway as a person approaches the front door or to illuminate a driveway as a car approaches.

The devices function by sensing heat emitted from a person or other warm object such as an automobile as the person or object enters the field of view of the device. When the device detects an appropriate heat impulse, it provides an electrical signal to activate the light or other alarm. A problem arises, however, because the devices may also detect heat from any number of extraneous sources within the device's field of view, which could trigger a false alarm or turn on a light at an unwanted time. To counter this problem, infrared motion detection devices typically include signal processing circuitry for distinguishing or discriminating in some measure a characteristic of the signal expected from the desired target. For example, some detection devices include two or more separate detector elements which sequentially receive infrared radiation as an intruder or target object moves across the device's field of view. The included circuitry looks for a sequence of two or more corresponding pulses as the heat from the target object falls on the detectors. Circuitry of this type is disclosed, for example, in U.S. Pat. Nos. 3,760,399; 3,631,434; and 3,958,118. Another type of circuitry looks for a single pulse generated when heat from the intruder or target object impinges upon a single detector element. This type of circuitry seeks to discriminate against unwanted signals by responding only to pulses of a minimum threshold size. In this way the circuitry distinguishes pulses generated by weak incident infrared radiation, which is less likely to come from a human source or a motor vehicle. Circuitry of this type is disclosed, for example, in U.S. Pat. Nos. 3,703,718 and 3,928,843. In addition, such single-pulse circuitry may also include two or more detector elements connected in opposition to one another to discriminate against overall background changes in temperature. A temperature change over the area covered by the multiple detector elements produces opposite signals in opposing detector elements, which cancel one another and prevent the device from responding with an alarm.

Motion detection devices with the above signal processing circuitry nevertheless may still suffer from occasional false alarms or false triggerings.

SUMMARY OF THE INVENTION

The present invention provides improved signal processing circuitry for motion detection devices which reduces the number of false alarms without adding appreciably to the cost of manufacturing the device. It has been discovered that the range of variation in the values of electrical components in motion detection devices, although falling within conventional manufacturing tolerances, introduces a source of false alarms. The present invention provides low-cost circuitry for overcoming that source of false alarms and avoids the need to employ other more expensive solutions such as selective assembly of individually tested components or special quality control procedures.

Briefly, an infrared motion detection device according to the invention includes signal processing circuitry that receives an electrical signal from the infrared detector or detectors, filters and otherwise processes that signal, and provides a derivative signal which is representative of radiation incident on the detector(s). The derivative signal is then compared with a threshold level as part of the process by which the device discriminates whether the incident radiation emanated from an intended target. According to the invention, coupling circuitry is interposed between the signal processing circuitry and the comparator circuitry which matches the baseline level of the derivative signal from the signal processing circuitry with the baseline level of the threshold or thresholds defined by the comparator circuitry. The base line matching technique counteracts the variations in voltage levels introduced by the range of manufacturing tolerances in the components and permits the motion detector device to be fabricated with lower-cost non-precision components without introducing unwanted false alarms. The coupling circuitry may be implemented in a particularly simple manner that may reduce the cost of the circuitry and the device even further.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
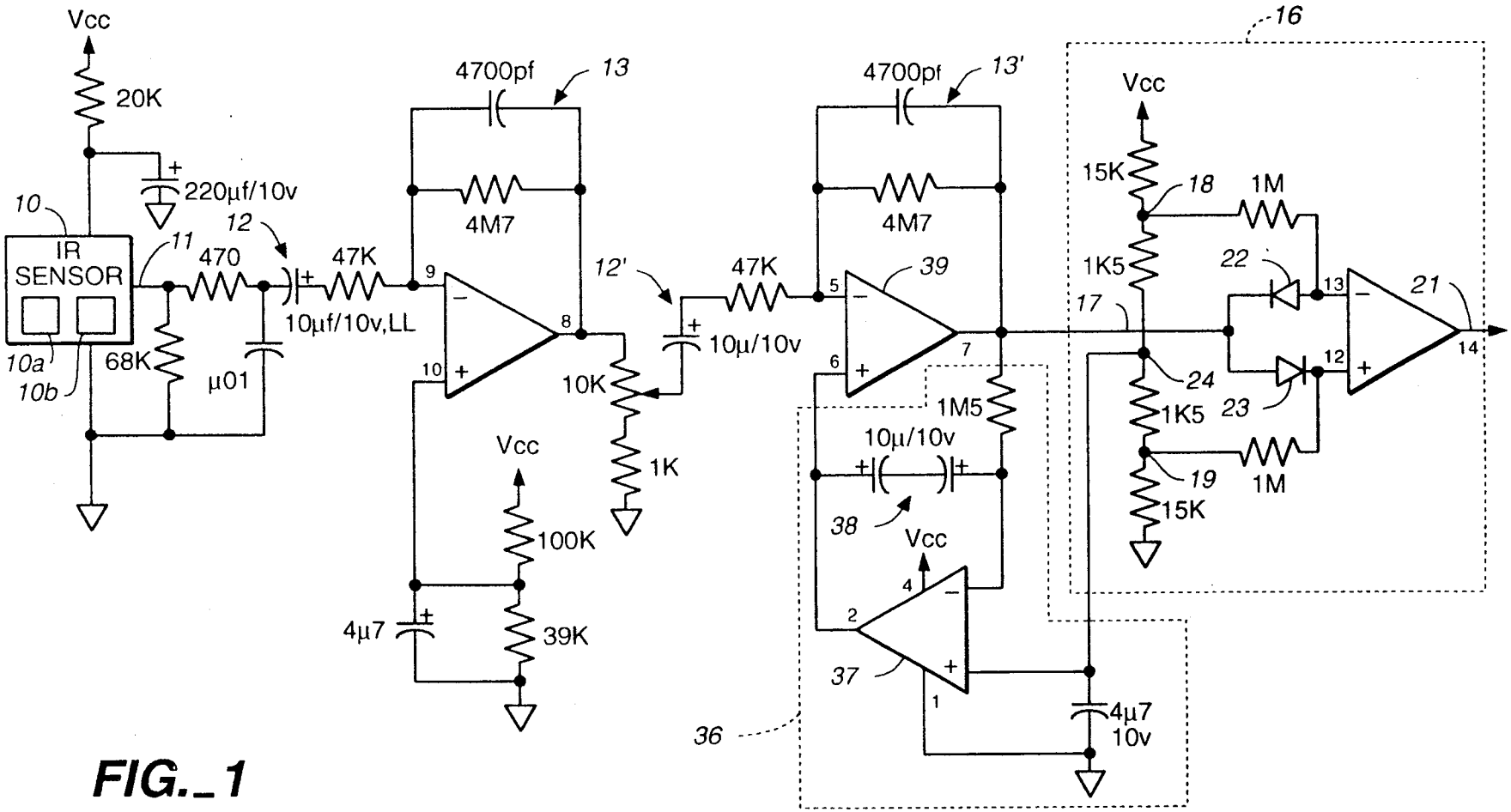
FIG. 1 is a schematic circuit drawing for motion detection circuitry in accordance with the invention.

FIG. 1 illustrates circuitry for an infrared motion detection device incorporating an embodiment of the present invention. The structure, operation and advantages of the invention will be better appreciated after a preliminary discussion of the functioning of this circuit without reference to the invention.

An infrared detector 10 receives infrared (IR) radiation from the region being monitored by the motion detection device and produces an output voltage signal on the line 11 representative of the incident IR radiation. Infrared detectors suitable for use in motion detection devices are well known in the art. By way of example, a popular unit for use in IR motion detection devices is a dual-element integrated-circuit detector chip, which provides two separate detector elements 10*a* and 10*b* on one chip with a single output line for the two detectors. Radiation striking each detector element generates a representative signal. The detector elements and chip circuitry are arranged so that if IR radiation strikes the two detectors simultaneously, the signals from the two detectors cancel and, in an ideal system, no signal appears on output line 11. If radiation strikes the two elements sequentially, then no cancellation occurs and two sequential, oppositely polarized signals are produced at the output line. Such dual-element detector chips are commercially available and need not be described in detail here as the details of their operation are not useful for an understanding of the present invention.

The detector output signal on line 11 is passed through two stages of signal processing where it is amplified and filtered to remove spurious signal components expected to come from sources unrelated to a person or similar warm target entering the detectors' field of view. Signal processing, and in particular filtering, serves to eliminate false alarms or false activation of a light by filtering out spurious frequencies, unrepresentative of the desired targets, that could nevertheless trigger such false alarms. Each stage includes a high-pass filter, indicated generally at 12 and 12', which filters out lower frequency components of the signal typically caused by variable environmental conditions such as local temperature variations or spurious signals caused by the wind. A low-pass filter at each stage, indicated generally at 13 and 13', similarly eliminates unwanted higher frequency components from spurious infrared radiation impinging on a detector or from induced electrical interference.

Block 16 is a window comparator, which receives the signal from the second signal-processing stage and determines whether it is of sufficient magnitude to warrant triggering the light or alarm. The window comparator thus serves as another method of avoiding false alarms. A desired target such as a person or a motor vehicle within the range of the motion detection device will emit, at a minimum, a comparatively large quantity of infrared radiation, and consequently undesired signals may be discriminated against on the basis of magnitude. A filtered electrical signal greater than a threshold magnitude is assumed to be generated by a desired target in the range of the device, and in response an alarm or light is triggered. Electrical signals less than the threshold value are assumed to be generated by something other than a desired target, and no alarm or light is triggered. The window comparator determines whether that threshold has been achieved.

The window comparator 16 illustrated in FIG. 1 responds to either positive or negative signals and is suitable for use with the dual-element detector chips referenced above, which may produce signals of either polarity. Window comparator 16 functions as follows. The signal at line 17 from the second signal-processing stage is applied to the window comparator and compared with the voltage V+ at node 18 (for positive signals) or with the voltage V− at node 19 (for negative signals). The voltage V+ is the threshold voltage for positive pulses and V− is the threshold value for negative pulses. If the magnitude of a positive or negative pulse exceeds V+ or V−, respectively, the output of operational amplifier 21 is high, signifying that the alarm or light should be energized. In steady-state operation the output of op amp 21 is held low, signifying that the alarm or light is not to be energized. While the comparator operation is described here in terms of idealized circuit elements, those skilled in the art will appreciate that the comparator op amp and the other op amps of the illustrated circuitry will typically be operated with a small input offset voltage as is common practice in the art. It is this input offset voltage that holds op amp 21 low in steady-state operation. The net result of the operation of window comparator 16 is to provide a signal, represented here by the high or low output of op amp 21, which is used to trigger a signal such as a signal to a relay or switch for energizing a light or alarm in response to the presence of a target object in the field of view of the device.

The operation of window comparator 16 may be illustrated by the response to a positive signal. In open-loop operation if the − input of operational amplifier 21 is higher potential than the + input, then the op amp output is low. When a positive signal is applied to line 17, diode 22 becomes non-conducting and prevents the potential at the − input of op amp 21 from rising. Diode 23 becomes conducting and raises the + input to a higher potential than the − input. The net result is that a positive signal on line 17 will be compared with the voltage V+ at node 18, and if the signal exceeds V+, the output of op amp 21 goes high. A similar circuit behavior may be traced when a negative pulse is applied at line 17. The nominal center of the window, i.e., the midpoint between the positive and negative thresholds, is the potential at node 24, serves as a common baseline level for the two thresholds.

In practice, actual circuits do not operate precisely as would be expected from the idealized circuit drawings due to imperfections in the circuit components. Such deviations, however, fall within the normally expected range of manufacturing tolerances and are normally considered acceptable. In the present case, for example, this means that the capacitors used in the filtering circuits and the detector chip 10 producing the initial electrical signal are known to "leak" due to the normal range of manufacturing tolerances, i.e., the capacitors may permit a small DC signal to pass. As a result, in an actual circuit the baseline level of the signal coming out of the second signal-processing stage tends to depart from a nominal zero value by a DC offset. The specific value of the offset will vary from device to device depending on the manufacturing tolerances for the components included in the device. It has been discovered that this offset can contribute significantly to false triggerings of the light when no target object is present.

Figure 2:
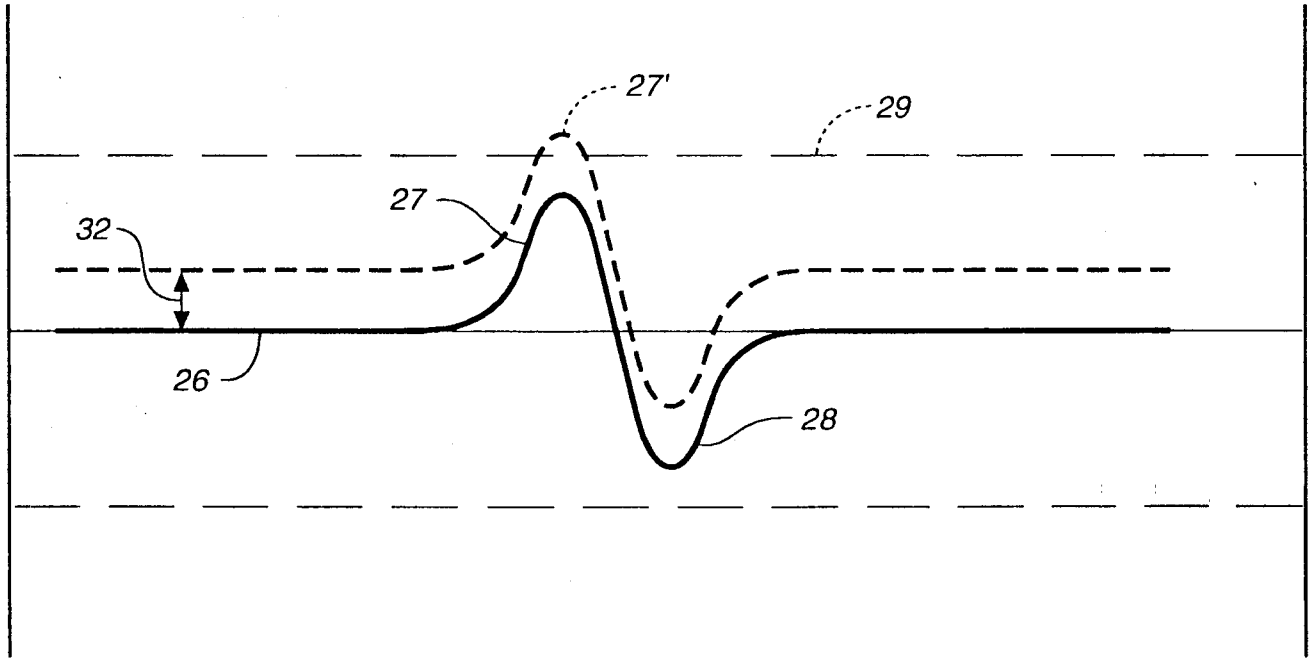
FIG. 2 is a graph showing illustrative signal patterns.

The problem may be seen with reference to FIG. 2, which shows an illustrative voltage signal 26 from the second signal-processing stage of an ideal circuit. The signal 26 shows a positive and negative pulse 27 and 28 generated by equal quantities of infrared radiation impinging sequentially on the two oppositely biased detector elements **10*a* and 10*b* of a dual-element detector chip. The pulses 27 and 28 are both too small to reach the threshold 29 and trigger the alarm. Also seen in FIG. 2 is a corresponding signal 26' with a DC offset 32 characteristic of leaky circuit components. Because of the offset, the sub-threshold pulse 27'** nevertheless exceeds the upper threshold and triggers the alarm.

To counteract the unbalancing effect of the DC offset voltage 32, the present invention couples the signal processing circuitry with the comparator in such a way that the steady-state DC output from the signal processing circuitry, which establishes the baseline level of the filtered signal, is matched up with the baseline level of the comparator threshold. In the case of window comparator 16, which defines two thresholds V+ and V− for oppositely polarized signals from the dual detector elements **10*a* and 10*b*, the baseline level of the filtered signal at line 17 is matched with the center of the window, i.e., with the common baseline for the two thresholds. In the embodiment of FIG. 1, for example, the coupling means is provided by an active network designated generally at 36, which serves to shift the baseline level of the filtered signal to the center of the window. Network 36 includes op amp 37 and offset-coupling network 38. The center voltage V0 of the window comparator at node 24 is applied to the +input of op amp 37, and the output of the second signal-processing stage is applied through offset-coupling network 38 to the − input of op amp 37. The difference is then applied to the + input of the final second stage op amp 39, which is coupled to the previous stage at the − input. Offset-coupling network 38** may be provided by an RC circuit having a time constant long compared with the anticipated period of the signal corresponding to a target person or object passing through the field of view of the detector. In this manner the output voltage of the second stage is adjusted by the amount of the DC offset to bring the output voltage to the level of the window center voltage V0.

Figure 3:
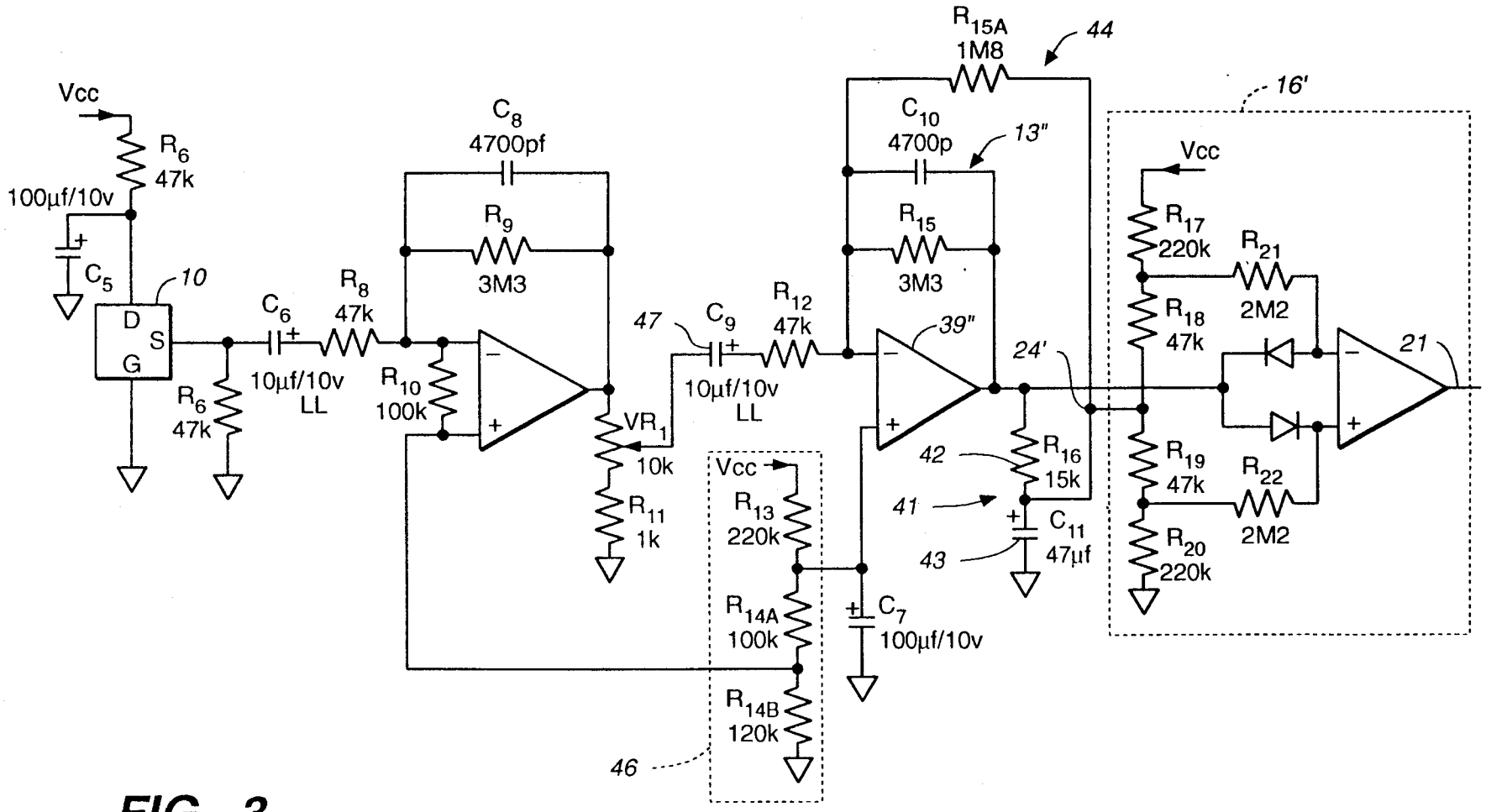
FIG. 3 is a schematic circuit drawings for an alternative embodiment of motion detection circuitry according to the invention.

FIG. 3 shows an alternative embodiment of the window centering means which uses only a passive network. Where the embodiment of FIG. 1 adjusts the output of the second stage to compensate for the DC bias, which is referenced to the center of the threshold window, the embodiment of FIG. 3 instead adjusts the window comparator to the output of the second stage. As illustrated in FIG. 3, window centering means 41 is provided by an RC network composed of resistor 42 and capacitor 43, and resistive feedback network 44. The RC network couples the output of the second stage op amp 39″ to the window center voltage V0 at node 24″. The RC network configured in this manner serves to add an additional pole to the frequency response of the circuit. This reduces the low-frequency and DC gain, which in effect also lowers the DC offset through the resistive feedback network 44. At very low frequencies or at the DC level, resistive network 44 looks as if it is in parallel with filtering circuit 13″, which lowers the overall DC gain of the second stage.

It will be noted that if the DC offset bias is too high, then the upper window threshold V+ will be limited by the positive voltage supply. To counter this problem, voltage divider network 46 and feedback resistor 42 cooperate to reduce the potential difference across the capacitor 47 to minimize leaking. Voltage divider network 46 is set so that the output of the second stage is higher than the output voltage level of the first stage.

The above provides a description of illustrative embodiments of the invention. Given the benefit of this description, various modifications and alternate configurations will occur to those skilled in the art, not all of which may be conveniently described herein. Accordingly, the invention is not intended to be limited only to the specific examples disclosed herein, but is defined by the appended claims.

What is claimed is:

1. In an infrared motion detection device for detecting the presence of a target object, said device including at least one infrared detector providing an electrical signal responsive to infrared radiation incident thereon, filter circuitry for processing said electrical signal, said filter circuitry receiving said electrical signal and providing a derivative signal representative of said incident infrared radiation, and comparator circuitry defining a threshold, said comparator circuitry receiving said derivative signal and providing an output signal in response thereto only when said derivative signal exceeds said threshold, said output signal being used to trigger a signal for energizing a light or alarm in response to the presence of said target object, the improvement comprising:

coupling means coupling said filter circuitry with said comparator circuitry for matching the baseline level of said derivative signal with the baseline level of said comparator threshold.

2. The device of claim 1 wherein said coupling means includes means for shifting the baseline level of said derivative signal to the baseline level of said threshold.

3. The device of claim 2 wherein said filter circuitry includes an output op amp providing said derivative signal and wherein said baseline-shifting means comprises difference means for applying the difference of said derivative signal baseline level and said threshold baseline level in negative feedback relation to an input of said output op amp.

4. The device of claim 1 wherein said coupling means includes means for shifting the baseline level of said threshold to the baseline level of said derivative signal.

5. The device of claim 4 wherein said filter circuitry includes an output op amp providing said derivative signal and wherein said baseline-shifting means comprises an RC network coupling the baseline level of said threshold to the output of said output op amp.

6. The device of claim 5 wherein said RC network comprises a first resistor interposed between said comparator circuitry at said threshold baseline level and the output of said output op amp at said derivative signal baseline level, and a capacitor interposed between said comparator circuitry at said threshold baseline level and ground.

7. The device of claim 6 further comprising a resistive feedback network interposed between said comparator circuitry at said threshold baseline level and an input of said output op amp in negative feedback relation.

8. The device of claim 7 wherein said RC network consists only of said first resistor and said capacitor and said resistive feedback network consists only of a second resistor.

9. In an infrared motion detection device for detecting the presence of a target object, said device including a pair of detectors, each providing an electrical signal responsive to infrared radiation incident thereon, filter circuitry for processing the electrical signals from said detectors and providing a derivative signal representative of said incident infrared radiation, said filter circuitry having a steady state output level, and window comparator circuitry defining a threshold window, said window comparator circuitry receiving said derivative signal and providing an output signal in response thereto only when said derivative signal falls outside the bounds of said threshold window, said output signal being used to trigger a signal for energizing a light or alarm in response to the presence of said target object, the improvement comprising:

window centering means coupling said filter circuitry with said window comparator circuitry for centering said threshold window with respect to the steady state output level of said filter circuitry.

10. The device of claim 9 wherein said filter circuitry includes an output op amp providing said derivative signal, and said window centering means consists of a first resistor interposed between said window comparator circuitry at the center level of said threshold window and the output of said output op amp, a capacitor interposed between said window comparator circuitry at said center level and ground, and a second resistor interposed between said window comparator circuitry at said center level and an input of said output op amp in negative feedback relation.

* * * * *